US009351063B2

(12) United States Patent
Burciu

(10) Patent No.: US 9,351,063 B2
(45) Date of Patent: May 24, 2016

(54) BLUETOOTH EARPLUGS

(71) Applicant: SONY CORPORATION, Tokyo (JP)

(72) Inventor: Liviu Burciu, San Diego, CA (US)

(73) Assignee: Sony Corporation, Tokyo (JP)

( * ) Notice: Subject to any disclaimer, the term of this patent is extended or adjusted under 35 U.S.C. 154(b) by 254 days.

(21) Appl. No.: 14/025,639

(22) Filed: Sep. 12, 2013

(65) Prior Publication Data

US 2015/0071457 A1 Mar. 12, 2015

(51) Int. Cl.
*H04R 1/10* (2006.01)

(52) U.S. Cl.
CPC ..... *H04R 1/1016* (2013.01); *H04R 1/1083* (2013.01); *H04R 2201/107* (2013.01); *H04R 2420/07* (2013.01); *Y10T 29/49005* (2015.01)

(58) Field of Classification Search
CPC ..... H04R 3/00; H04R 31/00; H04R 1/1016; H04R 1/1083; H04R 2201/107; H04R 2420/074
USPC ..... 381/74
See application file for complete search history.

(56) References Cited

U.S. PATENT DOCUMENTS 6,067,006 A * 5/2000 O'Brien ..... G04G 13/02 340/384.1
6,149,297 A * 11/2000 Beerwerth ..... G01J 5/02 340/541
6,819,256 B2 11/2004 Hampton
6,879,695 B2 4/2005 Maltan et al.
6,906,983 B2 6/2005 Williams et al.
7,039,195 B1 5/2006 Svean et al.
7,401,680 B2 7/2008 Kurth
7,512,247 B1 3/2009 Odinak et al.
7,551,940 B2 6/2009 Paulson et al.
7,680,292 B2 3/2010 Warren et al.
8,155,338 B2 4/2012 Wilmink
8,295,503 B2 10/2012 Sung et al.
8,340,339 B2 12/2012 Neu et al.
8,385,560 B2 2/2013 Solbeck et al.
2006/0140426 A1 6/2006 Berg
2006/0210104 A1* 9/2006 Shennib ..... H04R 25/00 381/315
2008/0298624 A1 12/2008 Jeong et al.
2010/0035648 A1 2/2010 Huang
2011/0103605 A1* 5/2011 Killion et al. ..... 381/72
2011/0109446 A1* 5/2011 Alves ..... 340/384.5
2011/0286608 A1 11/2011 Hautier et al.
2012/0121103 A1 5/2012 Cohen et al.
2013/0101130 A1* 4/2013 Bouhraoua ..... 381/72

* cited by examiner

*Primary Examiner* — Davetta W Goins
*Assistant Examiner* — Daniel Sellers
(74) *Attorney, Agent, or Firm* — Fitch, Even, Tabin & Flannery LLP

(57) ABSTRACT

A system and methods for providing a wireless earplug system are described. An earplug includes a wireless receiver/transmitter, a battery, a speaker, a sound canal and an on/off switch. The system also includes a controller including a wireless receiver/transmitter used to transmit wireless signals to the earplug. The earplug receives the wireless signals from the controller and plays audio sounds through the speaker and into the user's ear canal, thus enabling the user to hear the transmitted audio signals while ambient noises are blocked. The controller is also used to control the parameters of the time, duration and type of audio sounds.

13 Claims, 3 Drawing Sheets

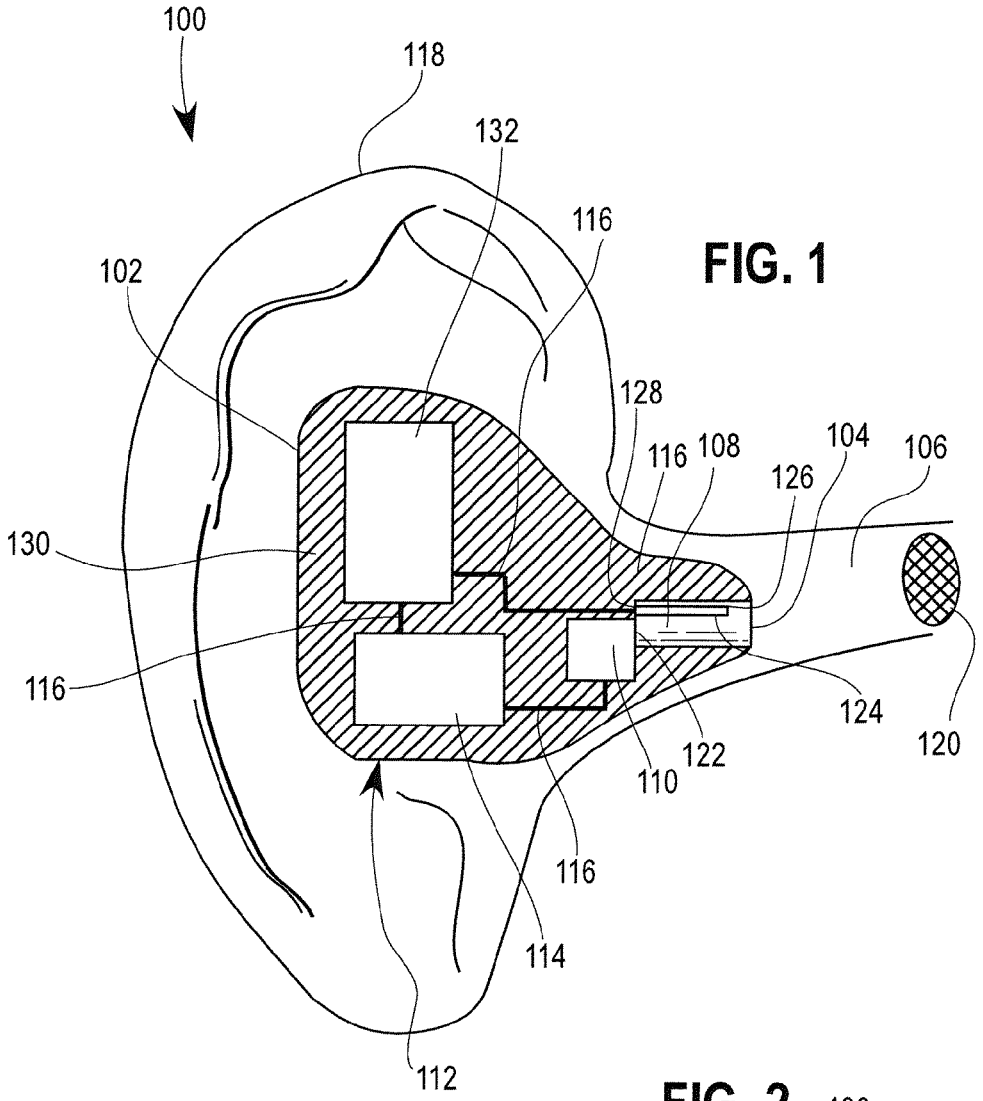
FIG. 1
FIG. 2
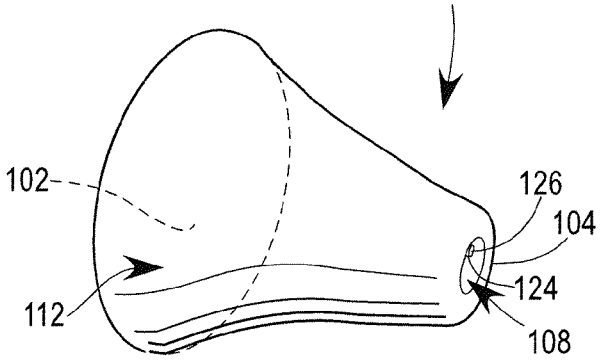

300

306
302
Speaker
wireless receiver/ transmitter module
110
100
114
304

306
Graphical User Interface
PLC
Wireless receiver/ transmitter module
400
406
memory
ear plug program
404
402
controller
304

BLUETOOTH EARPLUGS

BACKGROUND OF THE INVENTION

1. Field of the Invention

The present invention relates generally to earplugs, and more specifically to an earplug providing wireless communication with a mobile device and transmitting sounds through an integrated speaker 2. Discussion of the Related Art Earplugs are plugs that are inserted into the outer ear canal to block ambient sound and environmental noise. Earplugs are available in various sizes, shapes and materials.

Earplugs are frequently used by people who must sleep in a noisy environment. For example, earplugs are often used by airplane and train passengers traveling on long trips, sometimes overnight, and want to sleep during the trip. Earplugs are also used by people whose sleep is disturbed by ambient noise or a snoring spouse. Ear plugs are also useful to provide protection against hearing loss in a noisy environment such as a construction site or a rock concert.

The noise reduction or cancellation provided by earplugs blocks ambient sounds non-discriminately, which can sometimes have unintended side effects. For instance, those who wear earplugs while sleeping often need to wake up at a certain time and would ideally use an alarm clock to wake up on time. However, the use of earplugs while sleeping would prevent a user from hearing the alarm. In addition, earplugs can block emergency or warning signals, such as generated by a fire or security alarm, and potentially imperil the user.

Solutions to this problem are common in the prior art, and include placing the alarm closer to the user, substituting a vibrating device for the sound alarm, increasing the sound of the alarm, and using a wireless signal to transmit an alarm to a speaker contained within an earplug.

Wireless earplugs are found in the prior art. U.S. Pat. No. 6,067,006 to O'Brien (2000) describes a self-contained alarm and earplug apparatus. However, since the controls for operating the alarm are included on the earplug, the device is bulky and limited in operation.

In U.S. Pat. No. 7,512,247 to Odinak et al. (2009), the inventors include a carrying case that is used to program the wireless earplug for alarm times and sounds. U.S. Patent Application No. 2010/0035648 to Huang (2010) also describes a wireless earplug with a separate control module.

SUMMARY OF THE INVENTION

This invention provides systems and methods for an earplug system providing hearing protection and transmitting audio from a controller to a wireless earplug.

In one embodiment, the invention can be characterized as an earplug system comprising: an earplug comprised of a material suitable for hearing protection, and providing hearing protection when wedgingly inserted in an ear canal of a user, wherein a portion of the earplug proximate to an eardrum of the user is shaped to hold the earplug in place in the ear canal; a battery enclosed within the earplug; a first wireless receiver and transmitter enclosed within the earplug, distal to the ear canal, the first wireless receiver and transmitter electrically coupled to the battery, and receiving and transmitting at least one wireless signal; a speaker enclosed within the earplug and electrically coupled to the battery and to the first wireless receiver and transmitter, and receiving at least one audio signal from the first wireless receiver and transmitter; a sound canal bore embedded within the earplug, the sound canal bore extending from the speaker to an edge of the earplug proximate to the eardrum, whereby the sound canal bore is open to the ear canal at the edge of the earplug proximate to the eardrum; a controller comprising a second wireless receiver and transmitter, the second wireless receiver and transmitter transmitting at least another wireless signal to the first wireless receiver and transmitter, and receiving at least one wireless signal from the first wireless receiver and transmitter; a program module communicatively coupled to the second wireless receiver and transmitter and including a user interface configured for controlling the at least one wireless signal from the second wireless receiver and transmitter to the first wireless receiver and transmitter.

In another embodiment, the invention can be characterized as a method for constructing a wireless earplug system, comprising the steps of: electrically coupling a battery, a first wireless receiver and transmitter, and a speaker, the battery configured to provide power to the first wireless receiver and transmitter and the speaker; electrically coupling the speaker to the first wireless receiver and transmitter, the first wireless receiver and transmitter configured to transmit at least one wireless signal to the speaker, whereby the speaker outputs at least one audio signal; enclosing the battery, the first wireless receiver and transmitter, and the speaker within an earplug, the earplug shaped to fit within an ear of a user and comprising material suitable for providing hearing protection; including a sound canal bore within the earplug whereby a speaker output travels through the sound canal bore into an ear canal of the user; providing a controller including a second wireless receiver and transmitter, the second wireless receiver and transmitter configured to transmit and receive at least another wireless signal from the first wireless receiver and transmitter, and whereby the controller controls the at least one audio signal output by the speaker.

In a further embodiment, the invention may be characterized as a method for transmitting audio with a wireless earplug system, comprising: inserting by a user of at least one earplug, wherein at least one earplug is a wireless earplug including a battery, a first wireless receiver and transmitter, and a speaker; inputting an audio signal time into a controller the controller including a second wireless receiver and transmitter, whereby the controller transmits and receives at least one wireless signal; reaching the audio signal time; sending of at least one wireless audio signal from the controller to the wireless earplug; receiving of the at least one wireless audio signal by the first wireless receiver and transmitter; transmitting of an audio signal from the first wireless receiver and transmitter to the speaker; playing of the audio signal by the speaker, whereby the user hears the audio signal.

BRIEF DESCRIPTION OF THE DRAWINGS

The above and other aspects, features and advantages of several embodiments of the present invention will be more apparent from the following more particular description thereof, presented in conjunction with the following drawings.

FIG. 1 is a simplified section of a wireless earplug according to one embodiment of the invention.

FIG. 2 is a perspective view of the wireless earplug according to one embodiment of the invention.

Figure 3:
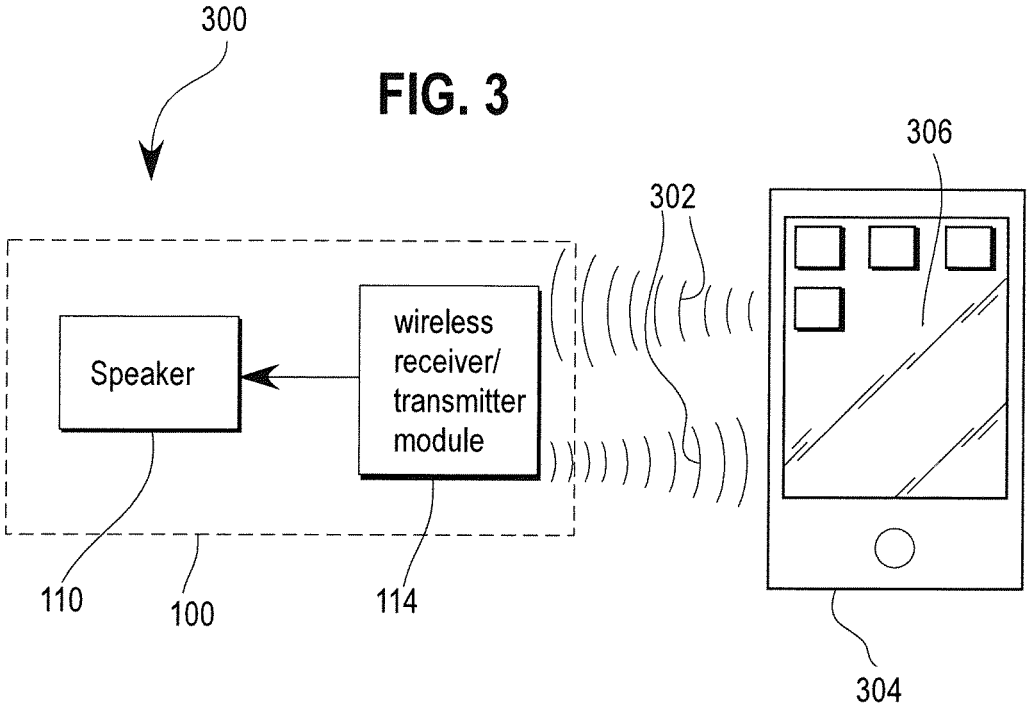
FIG. 3 is a schematic block diagram of the wireless earplug system according to one embodiment of the invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Referring first to FIG. 1, a simplified section of an embodiment of a wireless earplug 100 is shown. Shown are an outside edge 102, an inside edge 104, an ear canal 106, a sound canal bore 108, a speaker 110, an earplug surface 112, a wireless receiver/transmitter module 114, a plurality of connecting circuits 116, an ear 118, an ear drum 120, a speaker grill 122, an on/off switch 124, a first on/off switch end 126, a second on/off switch end 128, an earplug casing 130 and a battery 132.

The wireless earplug 100 is shown wedgingly inserted into the ear canal 106. In the present embodiment, the shape of the wireless earplug 100 is an approximately frustoconical shape with rounded edges. Other shapes may be used for the wireless earplug 100, such as musicians' earplugs or custom-shaped earplugs. The outside edge 102 is the larger generally circular edge of the approximately frustoconical shape and is located distal to the ear canal 106 when inserted into the ear 118. The inside edge 104 is the smaller generally circular edge of the approximately frustoconical shape and is located proximate to the ear drum 120 when inserted into the ear 118. The approximate diameter of the inside edge 104 may vary, but is approximately 9 mm.

The earplug casing 130 comprises rubber, silicone or other material suitable for providing hearing protection and being wedgingly inserted into the ear 118.

The wireless earplug 100 includes the sound canal bore 108. The sound canal bore 108 is generally cylindrical and the center axis of the sound canal bore 108 is approximately the center axis of the wireless earplug 100. The sound canal bore 108 extends from the inside edge 104 of the earplug to a distance approximately one-third to one-half the distance from the inside edge 104 to the outside edge 102. The sound canal bore 108 terminates at the speaker 110. The sound canal bore 108 diameter is less than the diameter of the inside edge 104, by an amount so that enough earplug casing 130 surrounding the sound canal bore 108 remains in order to prevent collapse of the sound canal bore 108 when inserted into the ear 118.

Enclosed within the earplug casing 130 are the battery 132, the wireless receiver/transmitter module 114, the speaker 110, and the plurality of connecting circuits 116.

The wireless receiver/transmitter module 114 is embedded in the earplug casing 130 and is proximate to the outside edge 102. The wireless receiver/transmitter module 114 includes components for transmitting and receiving wireless signals 302, for example Bluetooth signals or short wave radio signals. In the preferred embodiment of the invention, the wireless transmission components of the invention conform to the Bluetooth specification, using a controller 304 (shown below in FIG. 3) as the master device and the wireless earplug 100 as a slave device.

At least one connecting circuit 116 electrically couples the wireless receiver/transmitter module 114 to the speaker 110. The wireless receiver/transmitter module 114 includes components for transmitting audio signals to the speaker 110. The wireless receiver/transmitter module 114 is electrically coupled to the battery with at least one connecting circuit 116. The wireless receiver/transmitter module 114 has an approximate broadcasting range of 10 meters.

The battery 132 is embedded in the earplug casing 130. In the present embodiment, the battery 132 is located proximate to the outside edge 102 when the wireless earplug 100 is inserted in the ear 118. The battery 132 may be rechargeable or non-rechargeable. For a rechargeable battery, the earplug 100 is modified to provide access for a charging device (not shown). If the battery 132 is non-rechargeable, a portion of the earplug casing 130 between the battery 132 and the earplug surface 112 is removable and replaceable in order to allow for replacement of the battery 132.

The battery 132 is of a type suitable for providing power to the electrical components 110, 114, 124, and suitable for enclosing within the wireless earplug 100 in addition to the other necessary components. In the present embodiment, the battery 132 conforms to the Bluetooth Class 2 specification, although other wireless specifications may be used.

The battery 132 is electrically coupled to the wireless receiver/transmitter module 114, the speaker 110, and the on/off switch 124 with at least one connecting circuit 116 to each component 110, 114, 124.

The speaker 110 is embedded in the wireless earplug 100 adjacent to the end of the sound canal bore 108 distal to the ear canal 106 when the wireless earplug 100 is inserted into the ear 118. The speaker grill 122 is located at the end of the sound canal bore 108 distal to the ear canal 106, when the wireless earplug 100 is inserted into the ear 118, so that sound from the speaker 110 is projected through the sound canal bore 108 and into the ear canal 106.

The speaker 110 is electrically coupled to the wireless receiver/transmitter module 114 as detailed above and includes components to electrically receive transmissions from the wireless receiver/transmitter module 114 and broadcast them as audio sounds.

The on/off switch 124 is located within the sound canal bore 108 and is approximately cylindrical in shape. The longitudinal axis of the on/off switch 124 is approximately parallel to the longitudinal axis of the sound canal bore 108. The diameter of the on/off switch 124 is smaller than the diameter of the sound canal bore 108 so that enough void remains to transmit the audio into the ear canal 106. In the embodiment shown, the on/off switch 124 is adjacent to the inside face of the sound canal bore 108.

The first on/off switch end 126 is approximately located at the end of the sound canal bore 108 distal to the ear canal 106 when the wireless earplug 100 is inserted into the ear 118. The second on/off switch end 128 is located inside the sound canal bore 108, and extends far enough into the sound canal bore 108 that the on/off switch 124 may be toggled by a thin wire such as an unbent paperclip, but does not extend past the inside edge 104 of the wireless earplug 100 into the ear canal 106.

The on/off switch 124 is electrically coupled to the battery, as previously described, so that power to the wireless receiver/transmitter module 114 and the speaker 110 is controlled by the on/off switch 124. In the present embodiment, the on/off switch 124 is a toggle switch. Those skilled in the art will note that additional on/off switch 124 configurations are suitable. For example, a tubular on/off switch 124 may be located within the sound canal bore 108 and toggled on/off by using an external implement to press the tubular switch 124 towards the outside edge 102 of the wireless earplug 100.

Referring again to FIG. 2, the wireless earplug 100 is shown in operation in the ear 118.

The wireless earplug 100 is wedgingly inserted into the ear canal 106 far enough to hold the wireless earplug 100 in place during normal activities, but not far enough to damage the ear canal 106. The outside edge 102 and a portion of the wireless earplug 100 adjacent to the outside edge 102 remains outside the ear canal 106.

The wireless earplug 100 thus provides hearing protection to the ear 118, while functioning to receive wireless signals 302 and transmit them to the speaker 110. A user is then able to hear certain sounds while maintaining the hearing protection. The operation of the wireless earplug system 300 is described further below.

Referring next to FIG. 2, a perspective view of the exterior of the wireless earplug 100 is shown. Shown are the wireless earplug 100, the sound canal bore 108, the on/off switch 124, the inside edge 104, the outside edge 102, and the first on/off switch end 126.

The wireless earplug 100 is shown in an uninserted state. As previously described in FIG. 1, the earplug is an approximate frustoconical shape. The earplug is shown with the outside edge 102 on the left-hand side and the inside edge 104 on the right-hand side.

As shown, the sound canal bore 108 is visible at the inside edge 104 of the wireless earplug 100. A portion of the on/off switch 124, including the first on/off switch end 126, is visible in the sound canal bore 108. The other wireless earplug 100 components 110, 114 are inside the wireless earplug 100 and thus are not visible in FIG. 2.

Referring next to FIG. 3, a simplified schematic diagram of a wireless earplug system 300 is shown. Shown are the wireless earplug 100, the wireless receiver/transmitter module 114, the speaker 110, a plurality of wireless signals 302, the controller 304, and a graphical user interface 306.

The wireless earplug 100 shown in FIG. 3 is a simplified diagram of the wireless earplug 100 previously shown in FIGS. 1 and 2. Shown are the wireless receiver/transmitter module 114 and the speaker 110. Other components are not shown in FIG. 3 for clarity.

The wireless receiver/transmitter module 114 is electrically coupled with and transmits audio signals to the speaker 110, as shown in FIG. 1. The wireless receiver/transmitter module 114 sends and receives wireless signals 302 to and from the controller 304.

The controller 304 may be any device with components for running computer programs and transmitting and receiving wireless signals 302 compatible with the wireless earplug 100. In the embodiment shown, the controller 304 is a smartphone, but many devices are currently available or may be adaptable for use with the wireless earplug 100. Additional adaptable devices include personal computers, baby monitors, music players, and tablet computers.

The controller 304 has an approximate range for wireless receiving and transmitting of about 10 meters. The controller 304 also includes means for limiting the volume of the transmitted audio below a certain decibel level in order to prevent any hearing damage when the wireless earplug 100 is inserted into the ear 118.

Figure 5:
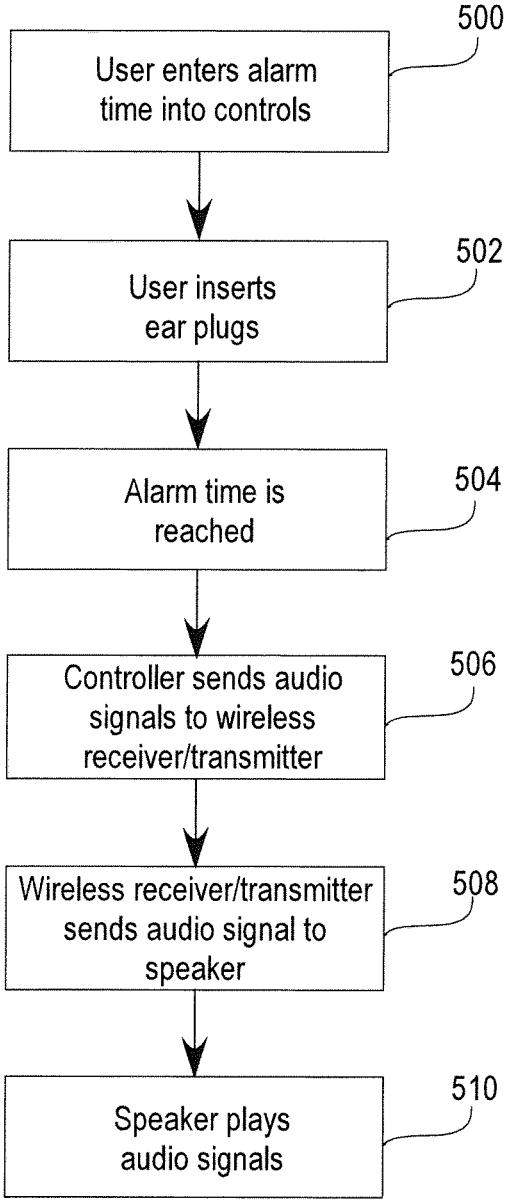
FIG. 5 is a flow diagram for a method of setting and playing of an audio alarm in one embodiment of the wireless earplug system.

The wireless signals 302 sent to the wireless earplug 100 are controlled through the graphical user interface 306. The graphical user interface 306 may be configured for various embodiments. One embodiment as shown below in FIG. 5 is to transfer an audio alarm to the wireless earplug 100. Another embodiment would transmit controller audio output, for example audio files, streaming audio or audio phone calls. Yet another embodiment utilizes a controller 304 microphone to transmit ambient audio, for example, as an assistive listening device. An exemplary assistive listening device usage includes the controller microphone placed near a television speaker and transmitting the television audio to the wireless earplug 100. In this manner, the wireless earplug 100 user can adjust the television audio volume without changing the television settings. Yet another embodiment of the present invention includes using the controller 304 as a filtering device, transmitting audio based on certain criteria set using the graphical user interface 306 or as pre-determined settings. Criteria examples include filtering audio phone calls based on the identity of the caller, and allowing high-decibel ambient audio, such as a fire alarm, to be transmitted to the wireless earplug 100.

The user interacts with the graphical user interface 306 to set the requirements for audio transmissions. The requirements may include, for example, volume control, time of an alarm (as shown below in FIG. 5), phone call rings, phone call audio, and audio email notifications.

The controller 304 may also be configured for pairing the controller 304 with the wireless earplug 100, as in the case of Bluetooth devices.

In operation, the wireless earplug 100 is inserted into the ear 118. The user uses the graphical interface to set parameters for sound transmission, for example time and duration of sound. The controller 304 then sends the wireless signals 302 to the wireless earplug 100 according to the previously set parameters. The wireless receiver/transmitter module 114 receives the wireless signals 302 and transmits them to the speaker 110. The speaker 110 outputs the transmissions as audio sounds, which then travel through the sound canal bore 108 in to the ear canal 106, where they are heard by the user.

Figure 4:
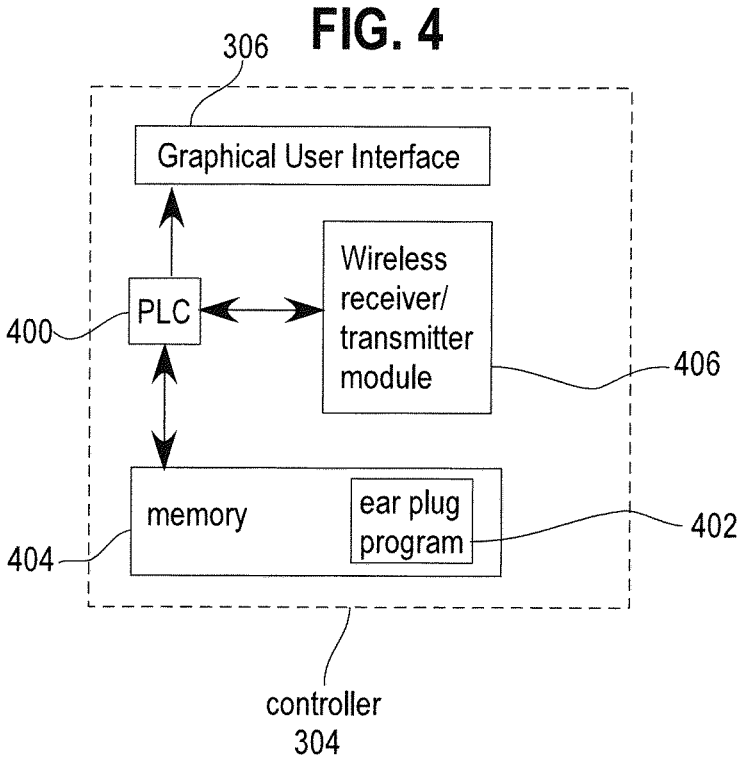
FIG. 4 is a schematic block diagram of a controller for the wireless earplug system according to one embodiment of the invention.

Referring next to FIG. 4, a schematic block diagram of the controller 304 is shown. Shown are the controller 304, the graphical user interface 306, a programmable logic controller (PLC) 400, an earplug program 402, a memory 404, and a wireless transmitter/receiver module 406.

The PLC 400 includes components necessary for operation of the controller 304 and running of the earplug program 402. The PLC 400 is electrically coupled to the earplug program 402, the graphical user interface 306, the memory 404, and the wireless transmitter/receiver module 406.

The controller 304 also includes the memory 404 for storing data. The memory 404 may be of any type as required for operation of the earplug program 402. The memory 404 also stores the earplug program 402. The memory 404 is electrically coupled to the PLC 400.

The earplug program 402 comprises a programming language compatible with the controller PLC 400, for example the Objective-C programming language for a PLC 400 with an iOS operating system. The earplug program 402 contains programming suitable for carrying out desired tasks, for example inputting and executing an alarm as shown in FIG. 5.

The wireless transmitter/receiver module 406 is electrically coupled to the PLC 400. The wireless transmitter/receiver module 406 receives audio signals from the PLC 400 as determined by the earplug program 402 and transmits them as wireless signals 302 to the wireless earplug 100 (shown in FIGS. 1-3).

Referring next to FIG. 5, a method for receiving a wireless earplug 100 audio alarm is shown. Shown are the alarm input step 500, the insert earplugs step 502, the alarm time step 504, the controller transmittal step 506, the wireless receiver/transmitter to speaker transmittal step 508, and the play alarm step 510.

During the initial alarm input step 500, the user interacts with the controller 304 (as shown in FIGS. 2-4) to input a future time for an alarm to be transmitted to the wireless earplug 100. The method then proceeds to the insert earplugs step 502.

The insert earplugs step 502 is shown following the alarm input step 500. During the insert earplugs step 502, the user inserts an earplug into each ear 118. The earplugs may both be wireless earplugs 100, or one earplug may be a wireless earplug 100 and the other a conventional earplug. The user now has hearing protection in both ears 118. The method then proceeds to the alarm time step 504.

The alarm time step 504 follows from the insert earplugs step 502. The alarm time step 504 is reached when the current time is equal to the alarm time set during the alarm input step 500. The method then proceeds to the controller transmittal step 506.

During the controller transmittal step 506, the controller 304 sends wireless signals 302 to the wireless receiver/transmitter module 114 (as shown in FIGS. 1-4). The method then proceeds to the wireless receiver/transmitter to speaker transmittal step 508.

The wireless receiver/transmitter to speaker transmittal step 508 follows the controller transmittal step 506. The wireless receiver/transmitter module 114 electrically transmits the wireless signals 302 received from the controller 304 to the speaker 110. The method then proceeds to the play alarm step 510.

During the play alarm step 510, the speaker 110 translates the audio signals into sounds and broadcasts them in to the sound canal. The user then hears the alarm.

Referring again to FIG. 5, a method for hearing an alarm while wearing earplugs for hearing protection is shown. There are many cases where it may be desired for the user to wear hearing protection, while still being able to hear certain sounds. One example of the method shown in FIG. 5 is wearing of hearing protection in a noisy environment in order to sleep, while still being able to hear a wake-up alarm.

As shown in FIG. 5, the first two steps in the method are to input an alarm time to the controller 304 and to insert at least one wireless earplug 100 into an ear 118. The other earplug may be a conventional earplug, a wireless earplug 100, or the user may choose to only wear the wireless earplug 100. The user may insert the wireless earplug 100 at any time prior to the alarm time.

During the alarm input step 500, the user may set parameters for the alarm, for example, volume, duration and type of sound. Default parameters may also be pre-set on the controller 304.

When the alarm time is reached, as in the alarm time step 504, the controller 304 sends the wireless signals 302 to the wireless earplug 100. The wireless signals 302 may be any sounds capable of being stored on the controller 304 and sent wirelessly to the wireless earplug 100, for example, a smartphone ringtone.

When the wireless receiver/transmitter module 114 receives the wireless signals 302, in the wireless receiver/transmitter to speaker transmittal step 508, the wireless receiver/transmitter module 114 electrically communicates the audio signal to the speaker 110.

Lastly, the speaker 110 receives the audio signal in the play alarm step 510, and the sound is played by the speaker 110. The user then hears the alarm. The alarm may be set to be a certain duration, or require the user to input a command to the controller 304 to cease the sound.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions that may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code could be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

While the invention herein disclosed has been described by means of specific embodiments, examples and applications thereof, numerous modifications and variations could be made thereto by those skilled in the art without departing from the scope of the invention set forth in the claims.

What is claimed is:

1. An ear plug system comprising:

an ear plug comprised of a material suitable for hearing protection, and providing hearing protection when wedgingly inserted in an ear canal of a user, wherein a portion of the ear plug proximate to an eardrum of the user is shaped to hold the ear plug in place in the ear canal;

a battery enclosed within the ear plug;

a first wireless receiver and transmitter enclosed within the ear plug, distal to the ear canal, the first wireless receiver and transmitter electrically coupled to the battery, and receiving and transmitting at least one wireless signal;

a speaker enclosed within the ear plug and electrically coupled to the battery and to the first wireless receiver and transmitter, and receiving at least one audio signal from the first wireless receiver and transmitter;

a sound canal bore embedded within the ear plug, the sound canal bore extending from the speaker to an edge of the ear plug proximate to the eardrum, whereby the sound canal bore is open to the ear canal at the edge of the ear plug proximate to the eardrum;

an on/off switch of the ear plug located within the sound canal bore, electrically coupled to the first wireless receiver and transmitter and configured for turning the ear plug on and off;

a controller comprising a second wireless receiver and transmitter, the second wireless transmitter and receiver transmitting at least another wireless signal to the first wireless transmitter and receiver, and receiving at least one wireless signal from the first wireless transmitter and receiver;

a program module communicatively coupled to the second wireless receiver and transmitter and including a user interface configured for controlling the at least one wireless signal from the second wireless receiver and transmitter to the first wireless receiver and transmitter.

2. The ear plug system of claim 1, wherein the ear plug further comprises a microphone electrically coupled to the first wireless receiver and transmitter, wherein the microphone transmits at least one audio signal from the user to the first wireless receiver and transmitter.

3. The ear plug system of claim 1, wherein the first wireless receiver and transmitter and the second wireless receiver and transmitter are Bluetooth receivers and transmitters.

4. The ear plug system of claim 1, wherein the first wireless receiver and transmitter and the second wireless receiver and transmitter are short-wave radio receivers and transmitters.

5. The ear plug system of claim 1, wherein the first wireless receiver and transmitter and the second wireless receiver and transmitter are infrared receivers and transmitters.

6. The ear plug system of claim 1, wherein the controller comprises a smartphone.

7. The ear plug system of claim 1, wherein the program module is configured for transmitting an audible alarm from the first wireless receiver and transmitter to the second wireless receiver and transmitter, whereby the audible alarm is output by the speaker.

8. The ear plug system of claim 7, wherein the program module is configured for terminating the audible alarm.

9. A method for constructing a wireless ear plug system, comprising:

electrically coupling a battery, a first wireless receiver and transmitter, and a speaker, the battery configured to provide power to the first wireless receiver and transmitter and the speaker;

electrically coupling the speaker to the first wireless receiver and transmitter, the first wireless receiver and transmitter configured to transmit at least one wireless signal to the speaker, whereby the speaker outputs at least one audio signal;

enclosing the battery, the first wireless receiver and transmitter, and the speaker within an ear plug, the ear plug shaped to fit within an ear of a user and comprising material suitable for providing hearing protection;

including a sound canal bore within the ear plug whereby a speaker output travels through the sound canal bore into an ear canal of the user;

including an on/off switch of the ear plug located within the sound canal bore, electrically coupled to the first wireless receiver and transmitter and configured for turning the ear plug on and off;

providing a controller including a second wireless receiver and transmitter, the second wireless transmitter and receiver configured to transmit and receive at least another wireless signal from the first wireless receiver and transmitter, and whereby the controller controls the at least one audio signal output by the speaker.

10. The method for constructing a wireless ear plug system according to claim 9, wherein the first and second wireless receivers and transmitters are Bluetooth receivers and transmitters.

11. The method for constructing a wireless ear plug system according to claim 9, wherein the first and second wireless receivers and transmitters are short-wave radio receivers and transmitters.

12. The method for constructing a wireless ear plug system according to claim 9, wherein the first and second wireless receivers and transmitters are infrared receivers and transmitters.

13. A method for transmitting audio using a wireless ear plug system, comprising:

inserting by a user of at least one ear plug, wherein at least one ear plug is a wireless ear plug including a battery, a first wireless receiver and transmitter, a speaker, a sound canal bore, and an on/off switch located within the sound canal bore, electrically coupled to the first wireless receiver and transmitter and configured for turning the ear plug on and off;

inputting an audio signal time into a controller the controller including a second wireless receiver and transmitter, whereby the controller transmits and receives at least one wireless signal;

reaching the audio signal time;

sending of at least one wireless audio signal from the controller to the wireless ear plug;

receiving of the at least one wireless audio signal by the first wireless receiver and transmitter;

transmitting of an audio signal from the first wireless receiver and transmitter to the speaker;

playing of the audio signal by the speaker, whereby the user hears the audio signal.

* * * * *